US005934127A

United States Patent [19]

Ihly

[11] Patent Number: 5,934,127

[45] Date of Patent: Aug. 10, 1999

[54] METHOD AND APPARATUS FOR REFORMING A CONTAINER BOTTOM

[75] Inventor: Eugene F. Ihly, Denver, Colo.

[73] Assignee: Ihly Industries, Inc., Englewood, Colo.

[21] Appl. No.: 09/076,684

[22] Filed: May 12, 1998

[51] Int. Cl.[6] ..... B21D 22/18

[52] U.S. Cl. ..... 72/110; 72/94; 72/379.4

[58] Field of Search ..... 72/84, 110, 117, 72/125, 111, 420, 94, 379.4

[56] References Cited

U.S. PATENT DOCUMENTS

| | | | |
|---|---|---|---|
| 3,688,538 | 9/1972 | Hoyne | 72/94 |
| 4,070,888 | 1/1978 | Gombas | 72/91 |
| 4,512,172 | 4/1985 | Abbott et al. | 72/68 |
| 4,563,887 | 1/1986 | Bressan et al. | 72/84 |
| 4,781,047 | 11/1988 | Bressan et al. | 72/84 |
| 4,885,924 | 12/1989 | Claydon et al. | 72/109 |
| 4,953,738 | 9/1990 | Stirbis | 230/606 |
| 5,222,385 | 6/1993 | Halasz et al. | 72/117 |
| 5,228,321 | 7/1993 | Shibasaka | 72/84 |
| 5,245,848 | 9/1993 | Lee, Jr. et al. | 72/84 |
| 5,325,696 | 7/1994 | Jentzsch et al. | 72/117 |
| 5,465,599 | 11/1995 | Lee, Jr. | 72/94 |
| 5,467,628 | 11/1995 | Bowlin et al. | 72/126 |
| 5,524,468 | 6/1996 | Jentzsch et al. | 72/117 |
| 5,540,352 | 7/1996 | Halasz et al. | 220/606 |

*Primary Examiner*—Joseph J. Hail, III
*Assistant Examiner*—Susan R. Kingsbury
*Attorney, Agent, or Firm*—Holme, Roberts & Owen

[57] ABSTRACT

A reforming apparatus, and method of using the same, is provided for reforming the bottom of a container to increase the dome reversal pressure and improve the drop resistance of a beverage container. The invention is particularly apt for use in reforming a beverage container integrally formed from a thin metallic sheet. Such containers generally have an open top portion connected to an outer wall that is disposed about a container axis. The outer wall is connected to a bottom portion having an annular support surface, an outer surface for connecting the annular support surface and the outer wall, a recessed or dome surface, and an inner surface for connecting the annular support surface and the dome surface. The invention provides a container rotating device for spinning, supporting, and positioning a container during reformation. A container positioning assembly is included to accurately position the container relative to reforming tools (e.g., rollers). The container positioning assembly includes an assembly for applying a resilient compressive force on the bottom portion of the container to maintain the container in an axially centered position within the reforming apparatus. The invention further comprises inner and/or outer rollers, disposed for outward and inward movement, respectively, for engaging and reforming the inner surface and/or outer surface of the bottom portion of a container body. In one embodiment, a single inner roller is disposed for reforming an inner surface while two outer rollers supportably engage an outer surface in opposing relation to the inner roller (e.g., the inner roller is positioned on a radius that is located between the radii on which the outer rollers are positioned).

32 Claims, 6 Drawing Sheets

METHOD AND APPARATUS FOR REFORMING A CONTAINER BOTTOM

FIELD OF THE INVENTION

The present invention generally relates to the manufacture of containers, and more particularly, to metal containers having an annular bottom portion that is contoured to enhance strength characteristics, including increased resistance to dome reversal and damage upon dropping. The present invention provides an improved method and apparatus for reforming the bottom portion of a metal container.

BACKGROUND OF THE INVENTION

Containers are manufactured in large quantities for a variety of purposes, including the containment of pressurized aerosols and beverages (e.g., soda, carbonated water, and beer). Such containers are generally made as thin as possible and with a configuration (e.g., necked-in ends) to minimize raw material (e.g., metal alloy) usage because even a small reduction in container thickness or change in shape can result in a substantial reduction in material costs for the manufacturer. In this regard, however, it is important that the required strength and other performance parameters of a container not be compromised by designs and manufacturing operations that reduce material usage.

Typically, beverage containers are manufactured from thin sheets of metal alloy that are subjected to a series of drawing, ironing, and forming operations. Initially, a metal sheet may be drawn into a seamless cup (e.g., a container with an open top portion, an outer wall, and a bottom portion) to establish an initial shape and inside diameter of the container. Subsequently, the container may be pushed through a series of ironing rings to thin the outer wall of the container to a selected thickness. During these ironing processes, the diameter of the container is typically maintained while the outer wall length is substantially increased to establish the fluid capacity of the container. The bottom portion of the container generally is formed to define a recessed or concave dome surface to resist deformation (e.g., due to internal fluid pressures). The pressure at which the recessed surface is deformed or reversed (e.g., pushed outward) is often called the static dome reversal pressure of the container. The bottom portion of the container also includes an annular support which will contact a supporting surface to maintain the container in a vertical position during stacking, consumer use, and the like. Finally, the bottom portion of the container generally contains outer and inner surfaces that join the outer wall to the annular support portion and that join the annular support portion to the domed surface, respectively.

The configuration of the bottom portion is important in facilitating material usage reductions since such configuration can be established to enhance strength characteristics. For example, the bottom portion may be configured to enhance static dome reversal pressure characteristics and to reduce the risk of damage caused when a filled container is dropped onto a hard surface during shipping, storage, and use. This drop resistance may be described as the cumulative drop height (taken from successive drops in which predetermined height increments are added to the previous drop height) at which the bottom portion is damaged sufficiently to preclude the container from standing upright on a flat surface.

As will be appreciated, it is known to reform the bottom portion of a container (e.g., after drawing and ironing processes) in order to define a configuration yielding improved strength characteristics. In this regard, however, known reforming methods and devices have generally presented reliability, repeatability and/or significant production cost drawbacks.

SUMMARY OF THE INVENTION

The present invention is directed to an improved apparatus for reforming a bottom portion of a container and associated methods of operation. The present invention is particularly suitable for reforming the bottom of drawn and ironed (D&I) metal containers.

Generally, these containers are cylindrical in shape with an outer wall disposed about a container axis. The container may be open at one end (e.g., a top portion) and closed at one end (e.g., a bottom portion). The bottom portion may include an annular support, an outer surface for connecting the outer wall and the annular support, a recessed or dome surface, and an inner surface for connecting the annular support and the dome surface.

As may be appreciated, the configuration of the bottom portion of the container is important to container manufacturers, distributors, retailers, and consumers because the bottom portion configuration affects a container's resistance to internal pressures (e.g., static dome reversal pressure), columnar or stacking strength, and drop resistance. Container manufacturers strive to improve material costs associated with container production by reducing the amount of metal alloy used in each container while maintaining and/or improving strength characteristics. In this regard, the present invention recognizes the importance of efficient and effective reformation of the bottom portion of a container, and particularly the inner and/or outer surfaces of the bottom portion, in improving production costs and enhancing production repeatability and reliability.

Generally, the reforming apparatus of the present invention includes a container rotating device, a container positioning assembly, and an inner and/or outer roller assembly, one or both of which roller assemblies may be employed to reform the bottom portion of a container. The container rotating device is configured to engage and to spin or rotate the container about its longitudinal center axis at a predetermined rate. As may be appreciated, the rotating device may contact one or more surfaces of the container to impart the desired spin rate and to otherwise support the open end of the container during reformation operations. For example, the container rotating device (e.g., a chuck, a jig, an extended hub, or the like) may be configured to engage and support interior and/or exterior surfaces of the open top portion of the container during reformation.

As noted, the reforming apparatus also includes a container positioning assembly for supporting and positioning the bottom end of a container. The container positioning assembly preferably includes an annular, recessed seat to selectively receive the annular support of the bottom portion of the container. In this regard, the container positioning assembly advantageously engages the container at a location proximate to the inner and outer surfaces of the bottom portion. As such, the container positioning assembly functions to accurately position the bottom portion relative to the inner and/or outer roller assemblies included in the reforming apparatus.

In one aspect of the present invention, the reforming apparatus is advantageously operable to resiliently apply a predetermined compressive force to the container along the container's axis. Such resiliently-applied, compressive force facilitates the maintenance of a desired container position during reformation of the inner and/or outer surfaces of the bottom portion. As may be appreciated, a compressive force may be resiliently applied by various resilient means including, the use of one or more springs in the container positioning assembly and/or the container rotating device.

In one arrangement, the container positioning assembly may include one or more springs for engaging (e.g., directly or indirectly) a bearing assembly having the above-noted seat interconnected thereto. The seat is configured and positioned to receive the annular support of the bottom portion as the container is axially advanced by the container rotating device to initially engage the container positioning assembly. As will be appreciated, it is beneficial for the seat of the container positioning assembly to be disposed to freely rotate (e.g., via the bearing assembly) with the spinning container during reformation operations. After initial engagement between the container and the seat, further axial travel of the container is resisted by the spring(s), and the container is thereby compressively loaded. To provide a preselected resilient force, the springs may be fabricated from various resilient materials, vary in number and size, and be chosen from a wide range of designs (e.g., helical, compression, and the like).

In another aspect of the present invention, the reforming apparatus facilitates effective reformation via the coordinated use of the above-noted inner and outer roller assemblies. Such roller assemblies are disposed in an opposing manner and may each include one or more freely-rotatable rollers that rollably engage the inner and outer surfaces, respectively, of the bottom portion of the container. Reformation of the inner and/or outer surface(s) is generally completed by advancing the inner and outer roller assemblies, respectively, so that the rollers initially rollably engage each rotating surface, and then further advancing the reforming roller(s) engaging the surface(s) to be reformed a predetermined distance to complete reformation of such surface(s). In this manner, the reformed surface(s) may partially or substantially take the shape of the reforming surface(s) of the corresponding reforming roller(s). The shape (e.g., outer cross-section) of a reforming surface may be, for example, arcuate, sinusoidal, etc.

As indicated, the rollers of the inner and outer roller assemblies will engage the inner and outer surfaces of the bottom portion of a spinning container upon advancing the assemblies inward and outward, respectively, toward each other a discrete distance from initial, unengaged positions. In this regard, effective reformation is at least partially dependent upon establishing and maintaining a desired position of the container relative to the roller assemblies. Generally, such positioning may be satisfied by maintaining axial centering of each container within the inventive reforming apparatus.

To enhance axial centering of the container, the seating surface of the container positioning assembly may be disposed concentrically about an axis of the seat, such axis corresponding with a center axis of the container positioning assembly. In this manner, the container is positioned (e.g., centered) so that the container axis coincides with the center axis of the positioning assembly. During reformation, the roller assemblies engage the bottom portion of the container and may apply forces that urge the container to become off-centered within the reforming apparatus. The above-noted resilient means, such as one or more spring(s), may be used to counteract the reformation forces and maintain the container in axial alignment. Further, the opposing engagement of the inner and outer surfaces of the bottom portion of a container by the inner and outer roller assemblies serves to advantageously support the container in a desired aligned position during reformation.

Of note, either or both of the inner and outer surfaces of the bottom portion of a container may be reformed in accordance with the present invention. By way of primary example, a single inner roller and two opposing outer rollers may be disposed for synchronized outward and inward radial movement, respectively, wherein upon engagement with the outer surface the outer rollers stop their inward travel while the inner roller continues its opposing, outward travel for a predetermined distance. Such an approach may yield a "hooked" inner surface in the bottom portion of a container as may be desirable for enhanced container performance. In this regard, the hooked region may be defined so that a portion thereof angles outward or is otherwise positioned radially outward of the annular support surface. As will be appreciated, in this example, the outer rollers serve to oppose outward movement of the container responsive to the inner roller movement during reformation (e.g., to help maintain the desired centering of the container body), thereby enhancing the repeatability and reliability of the reforming operation.

In another example, the inner and outer roller assemblies may be disposed for synchronized outward and inward radial movement, respectively, wherein upon engagement of the inner surface of a bottom portion the inner roller(s) stops its outward travel, while the outer roller(s) continues its inward travel for a predetermined distance. Such an approach yields a "hooked" outer surface for enhanced container performance in certain applications. In this example, the inner roller serves to oppose inward movement of the container body to yield enhanced reforming.

In yet a further example, reformation of inner and outer surfaces of the bottom portion of a container may be completed sequentially, partially concurrently, or concurrently. As can be appreciated, concurrent reformation may be preferable. In this approach, the rollers of the inner and outer roller assemblies are inwardly and outwardly advanced toward each other after container engagement, respectively, to opposingly apply reforming forces on the bottom portion of the container. By selecting reforming forces that are similar, axial centering of the container is enhanced.

Controlled and coordinated movement of the inner and outer rollers in the noted examples may be accomplished, for example, by coupling the roller assemblies to mechanical linkages, or via interconnection of the roller assemblies to cam followers that engage a cammed surface. In the later approach, a separate follower and cam surface may be provided for each roller. Alternatively, a separate follower for each roller assembly may be utilized to engage a common cam.

As can be appreciated, effective reformation of a container in the present invention depends upon controlling the movement of each roller as the reforming surface of the roller engages a container surface and as a given roller further advances to complete reformation. To engage and reform a container surface, a roller may be caused to follow, for example, a linear or an arcuate path. Linear movement of a roller may be obtained and closely controlled through the use of mechanical linkages driven by an actuating device, a cam and follower assembly, and/or an actuator employed to move mating components having cammed or angled surfaces. Arcuate movement of a roller may be closely controlled (i.e., the arcuate path being predetermined) by mounting of a roller(s) on a shaft that may be selectively rotated through an arc.

As previously indicated, the reforming rollers included in the inner and/or outer roller assemblies of the present invention preferably include a roller(s) that is allowed to freely rotate about a spindle or shaft (i.e., via a mating ball bearing). Lubrication of the inner and outer surfaces may also be employed to reduce friction during reformation. Additionally, material selection for the reforming surfaces of the roller(s) is important in reducing heat build up and heat transfer to the container and to neighboring components within the reforming apparatus. In this regard, the reforming surfaces of the roller(s) may be fabricated from materials, such as a ceramic-based materials, having desirable heat transfer characteristics (e.g., lower heat transfer coefficients) while maintaining hardness characteristics which facilitate reforming the metallic surfaces of a container.

Additional features and variations of the invention will become apparent to those skilled in the art upon consideration of the further description provided herein. Such additional embodiments and variations are intended to be within the scope of the present invention, as defined by the claims which follow this further description.

DETAILED DESCRIPTION

Figure 1:
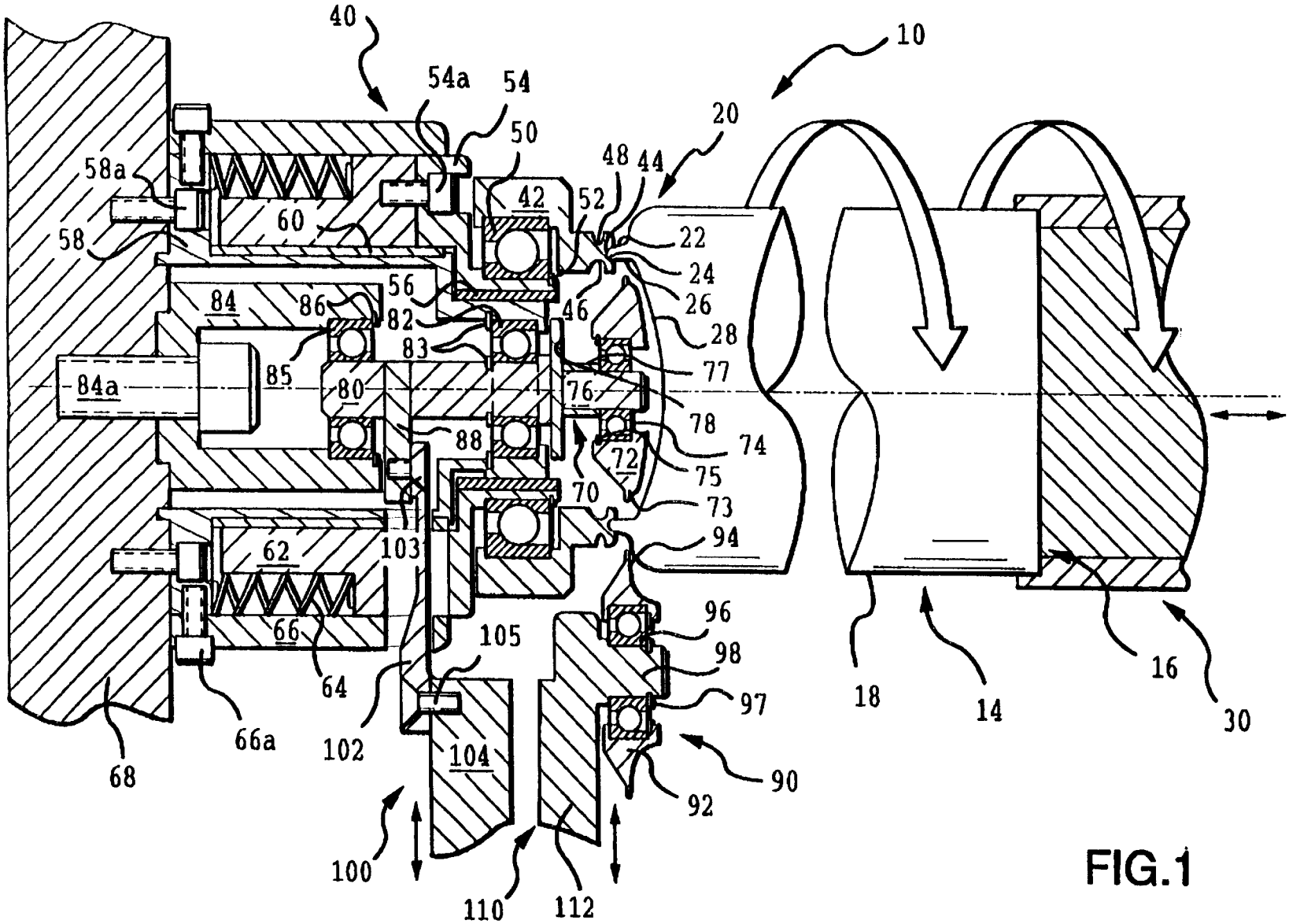
FIG. 1 is a sectional view of a container bottom reforming apparatus with a spinning container.

FIGS. 1–6D pertain to an embodiment of a container bottom reforming apparatus 10 for use in reforming a container 14 to improve the strength and drop resistance of the container 14 while maintaining or even reducing manufacturing costs. The reforming apparatus 10 includes a container rotating device 30, a container positioning assembly 40, an inner roller assembly 70, an outer roller assembly 90, and an inner and an outer roller positioning assembly, 100 and 110, respectively. As will become clear from the following description, these components of the reforming apparatus 10 may be operated in a coordinated manner to reform a bottom portion 20 of the container 14.

Referring to FIG. 1, container 14 includes an open top portion 16, an outer wall 18, and a closed bottom portion 20, each of which may be fabricated from a thin sheet of metal (e.g., aluminum or steel alloy). The bottom portion 20 includes an outer surface 22, an annular support surface 24, an inner surface 26, and a recessed surface 28. As illustrated, the container rotating device 30 is configured to engage the open top portion 16 of the container 14 and to provide internal and/or external support to the container 14 at the top portion 16. Following loading of the container 14, the container rotating device 30 also functions to spin the container 14 and axially advance the container 14 to engage the container positioning assembly 40 for reformation operations. As can be appreciated, various methods may be employed to rotate the container rotating device 30 and the engaged container 14. For example, a gear or belt drive with an extended hub (not shown) may be interconnected to the illustrated container rotating device 30.

Upon axial advancement of a container 14 (i.e., via axial displacement of rotating device 30), the container positioning assembly 40 functions to engage and control positioning (e.g., axial centering and longitudinal positioning) of the bottom portion 20 of the container 14 within the reforming apparatus 10. In the illustrated embodiment, the container positioning assembly 40 includes seat member 42, bearing 50, bearing sleeve 54, inner hub 58, thrust member 62, springs 64, outer collar 66, and base member 68. The seat member 42 receives the bottom portion 20 in a seating surface 44 configured to at least conformally engage the annular support surface 24 of the bottom portion 20. The seat member 42 further includes an inner and an outer recessed surface 46 and 48 to provide clearance between the inner and the outer roller assembly 70 and 90, respectively, during operation of the reforming apparatus 10 without a container 14 supported on the container rotating device 30 (e.g, in the event a container 14 is misfed or not fed into the reforming apparatus 10). The seat member 42 freely rotates with the container 14 during reformation operations. In this regard, the seat member 42 is supported within the container positioning assembly 40 by bearing sleeve 54 and interdisposed bearing 50. The bearing 50 (e.g., an angular contact ball bearing or the like) is maintained on the bearing sleeve 54 with retaining ring 52, while the coupled seat member 42 is free to rotate with the container 14.

To enhance the maintenance of axial alignment of the bottom portion 20, the container positioning assembly 40 includes springs 64. Spring 64 serves to apply a resilient, compressive load on the container 14. As can be appreciated, the springs 64 may be varied in type (e.g., helical, compression, and the like), number, size, and material to obtain the desired compressive force on the bottom portion 20 of the container 14. As illustrated, the springs 64 are disposed between surfaces of the inner hub 58, the thrust member 62, and the outer collar 66. To structurally support the container positioning assembly 40, the inner hub 58 is coupled to the base member 68 with screws 58*a* and the outer collar 66 is coupled to the inner hub 58 with screws 66*a*. The inner hub 58 and the outer collar 66 are configured to house the springs 64, the thrust member 62, and a bearing 60. The bearing 60 is included to facilitate movement of the thrust member 62 and, correspondingly, the springs 64 during operation of the reforming apparatus 10. The springs 64 and the thrust member 62 are in face-to-face contact so that any forces developed in the springs 64 during operation of the reforming apparatus 10 are transferred to the thrust member 62. Similarly, thrust member 62 is interconnected via screws 54*a* to bearing sleeve 54 to transfer this developed spring force to bearing 50 and finally, to seating member 42 that is engaging annular support surface 24 of bottom portion 20. To facilitate the transfer of the spring force and the corresponding motion of components, the container positioning assembly 40 includes bearing 56 which is disposed between the bearing sleeve 54 and the inner hub 58.

As noted above, reforming apparatus 10 includes inner roller assembly 70 and inner roller positioning assembly 100. Various designs for the inner roller assembly 70 and the inner roller positioning assembly 100 may be utilized including, for example, the use of one or more linkages and/or the use of a cam and roller assembly to selectively cause a roller(s) to advance on a substantially linear path to contact the inner surface 26. Alternatively, such mechanisms may be provided to advance roller(s) on an arcuate path to contact inner surface 76. Further, the shape of contacting surfaces of a reforming roller(s) may be selected from various cross-sections including arcuate, and waved (e.g., two or more arcuate cross-sections in series).

In the illustrated arrangement, the inner roller assembly 70 is centrally positioned and structurally supported within reforming apparatus 10 by a support sleeve 84 coupled via screw 84*a* to base member 68. The inner roller assembly 70 includes a central support or shaft member 80 supported by support sleeve 84 through the use of bearing 85 (e.g., an angular contact ball bearing press-fit on central support member 80 and positionally maintained by retaining ring 86). In this manner, central support member 80 is supported and centrally positioned (e.g., the central axis of central support member 80 coincides with that of container 14) and may be rotated relatively to support sleeve 84. The central support member 80 is further supported and centrally positioned through the use of bearing 82 (e.g., an angular contact ball bearing) which is disposed between the central support member 80 and the inner hub 58 of the container positioning assembly 40 and is positionally maintained with retaining rings 83.

Figure 3:
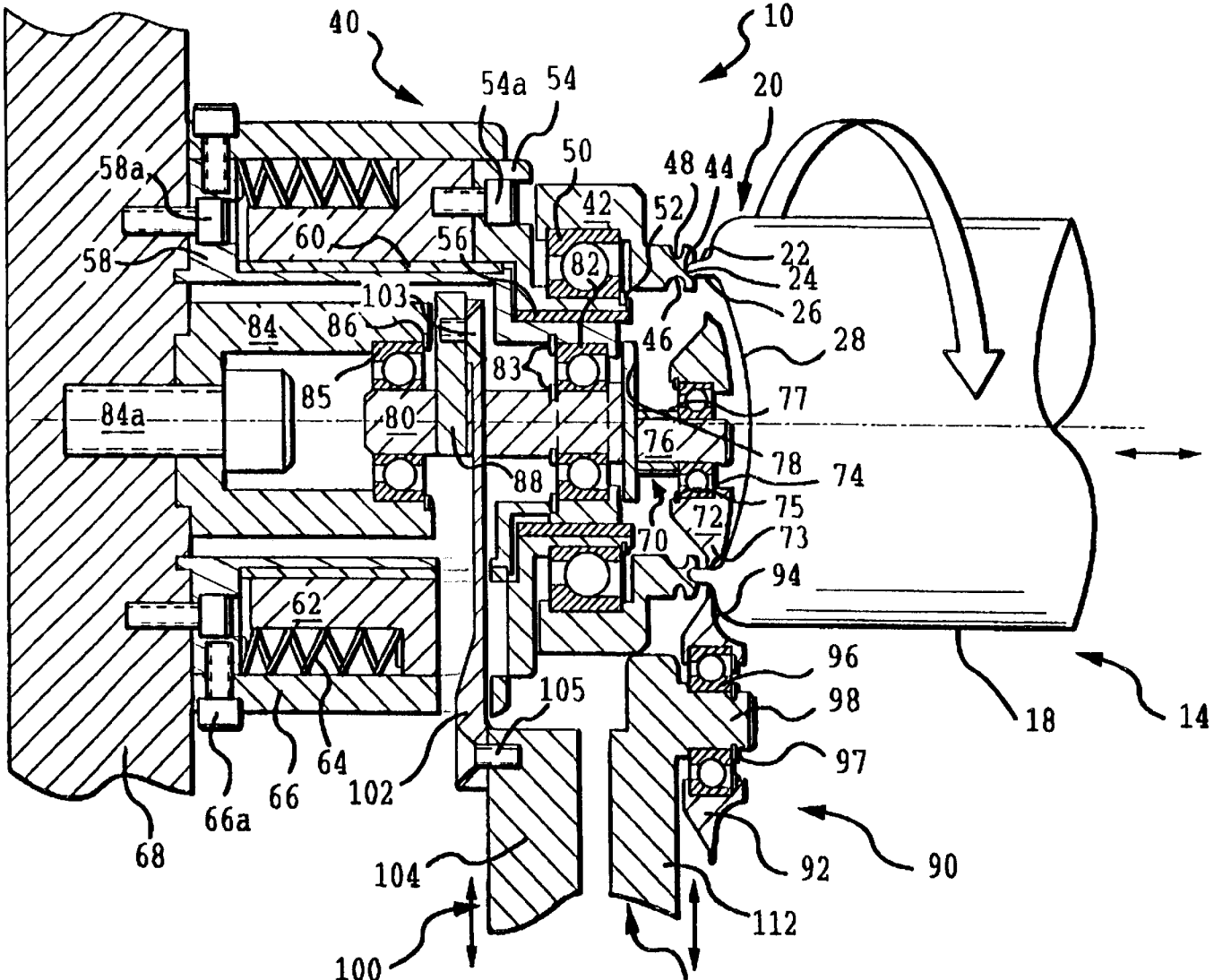
FIG. 3 is a sectional view of the container bottom reforming apparatus of FIG. 1 illustrating initial engagement of inner and outer rollers with the spinning container.

Referring to FIG. 3, the inner roller assembly 70 includes a plate 78 coupled (e.g., through welding or the like) to the central support member 80 to provide a surface that facilitates eccentric mounting of a spindle 76 relative to the central support member 80. The inner roller assembly 70 further includes inner roller 72, bearing 74, retaining ring 75, and spindle collar 77. The spindle collar 77 is concentrically positioned on spindle 76 to facilitating positioning of bearing 74, which is press-fit on spindle 76 and positionally maintained with retaining ring 75. The inner roller 72 is coupled (e.g., by press-fitting and using retaining ring 75) with bearing 74 thereby, allowing free rotation of inner roller 72 about spindle 76 during engagement of inner roller 72 with the inner surface 26 of bottom portion 20. In this regard, inner roller 72 may include surface 73 that engages and may selectively provide a reforming shape that will be imparted to the inner surface 26 during inner surface 26 reformation. Refer to FIGS. 6A–6D for various reforming shapes for reforming surface 73. The reforming surface 73 may be fabricated from various materials suitable for reforming the container 14, including a material (e.g., a ceramic material) with relatively low thermal conductivity characteristics.

To provide selective advancement inner roller 72 to cause engagement with inner surface 26, the inner roller assembly 70 includes a connecting member 88 mounted on central support member 80. The connecting member 88 couples (e.g., with screw 103) the inner roller assembly 70 to the inner roller positioning assembly 100. The inner roller positioning assembly 100 includes an arm 102 coupled to a follower 104 by screw 105, and a cam (not shown). As will be appreciated, the cam may be provided on a stationary surface relative to which the entire reforming apparatus 10 rotates during reformation operations. In this regard, in a production implementation, a plurality of the reforming apparatus 10 may be disposed on a central carrier member that rotates relative to an outer stationary member having a raised cam surface provided thereupon.

In the illustrated apparatus 10, the arm 102 interconnects connecting member 88 of inner roller assembly 100 and follower 104 of inner roller positioning assembly 100. As can be appreciated from referring to FIGS. 1–5, the movement of the follower 104 causes arm 102 and connecting members to move in a similar direction which urges central support member 80 to rotate about its central axis. Further, the eccentric mounting of spindle 76 causes spindle 76 and inner roller 72, mounted thereon, to travel or advance in an arcuate path as central support member 80 is rotated by follower 104. The arcuate path inner roller 72 travels can be accurately controlled (e.g., by the accurate positioning of spindle 76 on plate 78) to provide a desired engagement or contact between inner roller 72 and inner surface 26 of bottom portion 20. As noted above, the inner roller assembly 70 and inner roller positioning assembly 100 may also be disposed to provide for linear advancement of roller 72 towards inner surface 26 during reformation operations.

Reforming apparatus 10 also includes outer roller assembly 90 and outer roller positioning assembly 110. Again, various designs for outer roller assembly 90 and outer roller positioning assembly 110 may be utilized including, for example, the use of one or more linkages and/or the use of a cam and follower assembly to selectively cause a reforming roller(s) to advance on a substantially linear path to contact the outer surface 22. The shape of contacting surfaces of the roller(s) for assembly 90 may be selected from various cross-sections, including arcuate and waved (e.g., two or more arcuate cross-sections in series). Again, refer to FIGS. 6A–6D for examples.

Figure 2:
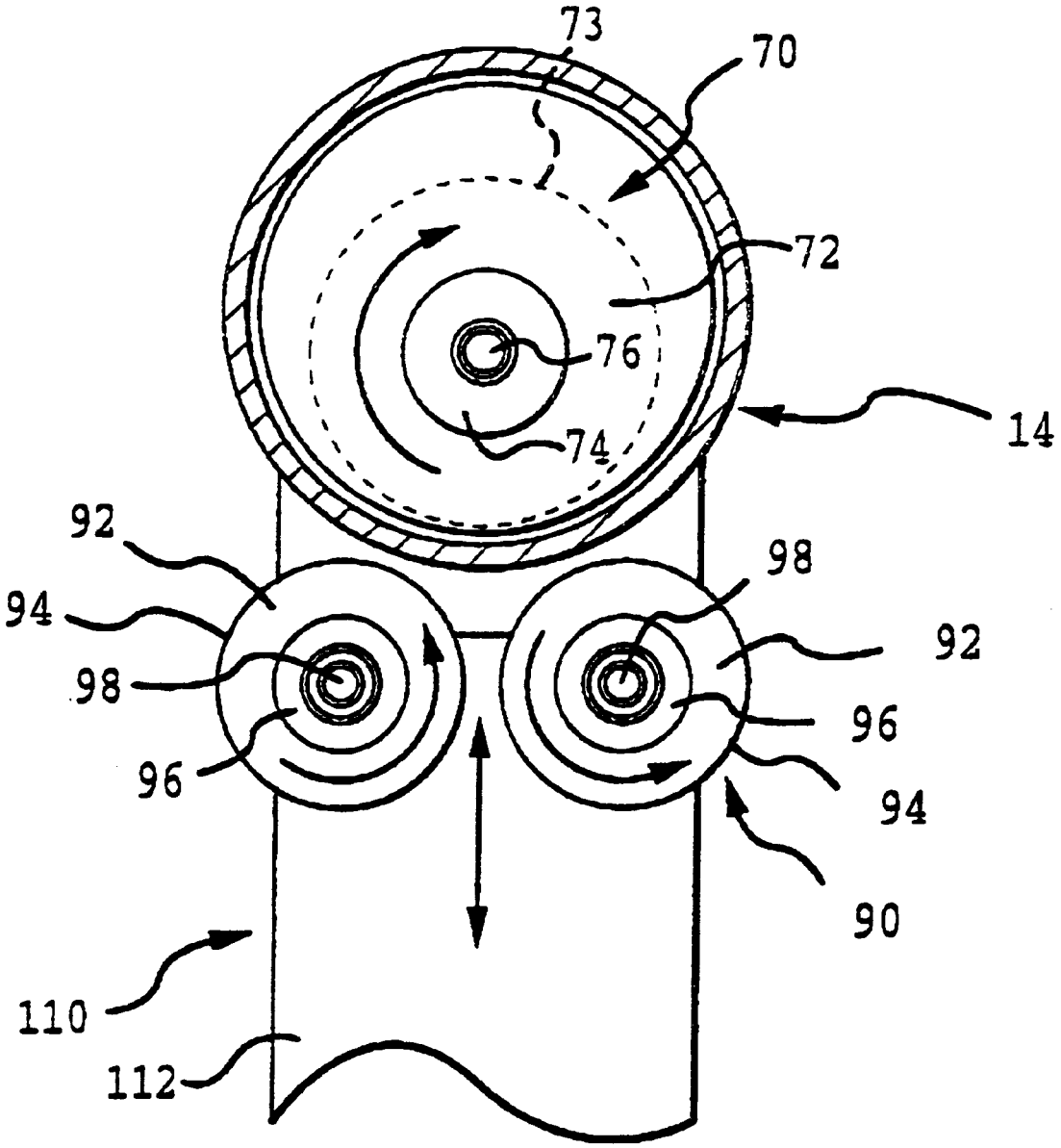
FIG. 2 is a partial end view of a container bottom reforming apparatus illustrating the outer roller assembly of the container bottom reforming apparatus of FIG. 1.

In the illustrated arrangement, outer roller assembly 90 is supported by outer roller positioning assembly 110 and is disposed so that assembly 110 will control the amount of travel of outer roller assembly 90 during reformation operations. Referring to FIG. 2, the outer roller assembly 90 includes two outer rollers 92, bearing members 96, and spindles 98. As can be appreciated, a single roller(s) may also be employed in roller assembly 90.

In the arrangement of FIG. 2, the outer rollers 92 are fit onto bearing members 96 (e.g., angular contact ball bearings or the like) which in turn is coupled to spindles 98. Bearing members 96 are positionally maintained with retaining rings 97. The use of bearing members 96 allows outer rollers 92 to freely rotate relative to spindles 98 during engagement with outer surface 22. As will be appreciated, outer rollers 92 may be spaced so that inner roller 72 may engage container 14 at a location that is on a radius that passes between the regions engaged by rollers 92. Reforming surfaces 94 may be fabricated from various materials appropriate for reforming outer surface 22, including materials having a relatively low thermal conductivity properties, (e.g., a ceramic-based material).

To advance outer rollers 92 to selectively engage outer surface 22, the spindles 98 are interconnected to a follower 112 of the outer roller positioning assembly 110. As may be appreciated, the spindles 98 may be rigidly mounted (e.g., with welding) on follower 112 or, alternatively, the spindles 98 and the follower 112 may be fabricated from a single piece of material (e.g., metal alloy). The follower 112 may be interconnected with or contact a cam (not shown) or other device employed to provide selective movement of follower 112 during reformation. The rigid mounting of the spindles 98 on follower 112 causes any movement imparted to follower 112 to also be imparted to the spindles 98 and to the interconnected outer rollers 92. In this manner, the outer roller positioning assembly 110 may be employed to urge reforming surfaces 94 of outer rollers 92 to selectively engage outer surface 22.

Referring to FIGS. 1–4, one method embodiment of reforming bottom portion 20 of container 14 with reforming apparatus 10 will be now be presented. Initially, container 14 is loaded into reforming apparatus 10 and engaged at top portion 16 by container rotating device 30. Container rotating device 30, at least internally, supports container 14. Next, container rotating device 30 axially advances container 14 to contact container positioning assembly 40. Referring to FIG. 1, annular support surface 24 of bottom portion 20 is received by seating surface 44 on seat member 42 of container positioning assembly 40. The container rotating device 30 further urges the container 14 against seat member 42. This urging force is in turn transferred from seat member 42 to bearing 50, to bearing sleeve 54, to thrust member 62, and finally, to springs 64 so that springs 64 are at least partially compressed. As may be appreciated, by choosing various sizes, types, materials, and numbers of springs 64, a resiliently-applied, compressive load may be selectively established (e.g., in relation to the desired reformation of containers 14 having various materials and wall thicknesses).

The use of springs 64 (e.g., a resilient member) facilitates accurate positioning of the bottom portion 20 relative to inner roller assembly 70 and outer roller assembly 90 by controlling movement of the seat member 42. Referring to FIG. 1, as springs 64 are compressed, seat member 42 is repositioned so that inner surface 26 and outer surface 22 of bottom portion 20 are positioned adjacent to inner and outer rollers 72 and 92, respectively.

As will be appreciated, the container rotating device 30 is operated to rotate at a selected speed for reformation. As the container rotating device 30 rotates, container 14 and contacting seat member 42 will rotate therewith. In this regard, seat member 42 is supported by bearing 50 to allow free rotation of seat member 42 with container 14. The seat member 42 supports the spinning container 14 at the bottom portion 20, and particularly, supports the bottom portion 20 proximate to outer and inner surfaces 22 and 26, while also maintaining the application of the above-noted resilient, compressive, axial load on container 14.

Next, and as shown in FIG. 3, inner roller positioning assembly 100 and outer roller positioning assembly 110 may be operated to advance (e.g., at least partially simultaneously) inner and outer rollers 72 and 92, respectively, to engage the inner and outer surfaces 26 and 22. In this regard, the present invention provides for at least three different reforming operations upon engagement. In a first operation, the outer rollers 92 will upon engagement with the outer surface 26 of container 14 stop inward travel relative to container 14 while the inside roller 72 will continue its outward advancement (i.e., after engagement) to reform the inner surface 26 of the container 14. In this operation, and as shown in FIG. 2, the inner roller 72 is positioned relative to the outer rollers 92 so as to engage and reform the inner surface 26 at a location which is positioned between the engagement regions corresponding with rollers 92. It has been found that such relative positioning of the inner roller 72 and outer rollers 92 is particularly effective in achieving the desired reformation shape on the inside surface 26 of a container 14.

In an alternate operation, one or more rollers comprising inner roller assembly 70 may upon engagement with the inner surface 26 of container 14 to stop their outward travel, while one or more rollers of outer roller assembly 90 may continue their inward advancement after engagement with the outer surface 22 of container 14. In such an arrangement, the outer surface 22 may be reformed as desired while maintaining the inner surface 26 in its original configuration.

In yet a third operation that may be conducted in accordance with the present invention, both the inner roller assembly 70 and outer roller assembly 90 may be provided so that they will continue their outward and inward advancements, respectively, after engagement with container body 14 to yield at least partially simultaneous reformation of both the inside surface 26 and outside surface 22 of a container 14. In this regard, reformation of both of the inner and outer surfaces 26 and 22 may also be accomplished in series (e.g., first, the inner surface 26 and second, the outer surface 22).

In order to provide the desired reformation operation, followers 104 and 112 of the inner and outer roller positioning assemblies 100 and 110, respectively, may be separate members as illustrated, or may be slidably interconnected (e.g., to use one follower) while still being separately advancable/retractable. As illustrated, follower 104 of the inner roller positioning assembly 100 is separated from follower 112 of the outer roller positioning assembly 110. This facilitates the use of separate cams to establish and control the movements of followers 104 and 112, and interconnected inner roller 72 and outer rollers 92, as may be desired for carrying out a given reformation operation.

Referring to FIGS. 1–5, the illustrated embodiment employs separate followers 104 and 112 to, at least partially, concurrently advance inner and outer rollers 72 and 92, respectively, to concurrently engage inner and outer surfaces 26 and 22 of bottom portion 20, and to reform at least the inner surface 26. As illustrated, follower 104 of inner roller positioning assembly 100 is in contact with a cam (not shown), and as the apparatus 10 rotates relative to the cam, the follower 104 is moved radially inward and outward relative to container positioning assembly 40. As follower 104 moves toward container positioning assembly 40, arm 102 is forced radially into container positioning assembly 40 and moves connecting member 88 to rotate central support member 80 within bearings 82 and 85. Referring to FIGS. 1 and 3, this rotation of central support member 80 and interconnected plate 78 causes eccentrically mounted inner roller 72 on spindle 76 to travel or advance along an arcuate path to initially engage inner surface 26 of spinning bottom portion 20 with reforming surface 73.

As reforming surface 73 of inner roller 72 contacts inner surface 26, the inner roller 72 begins to freely rotate about bearing 74.

Figure 4:
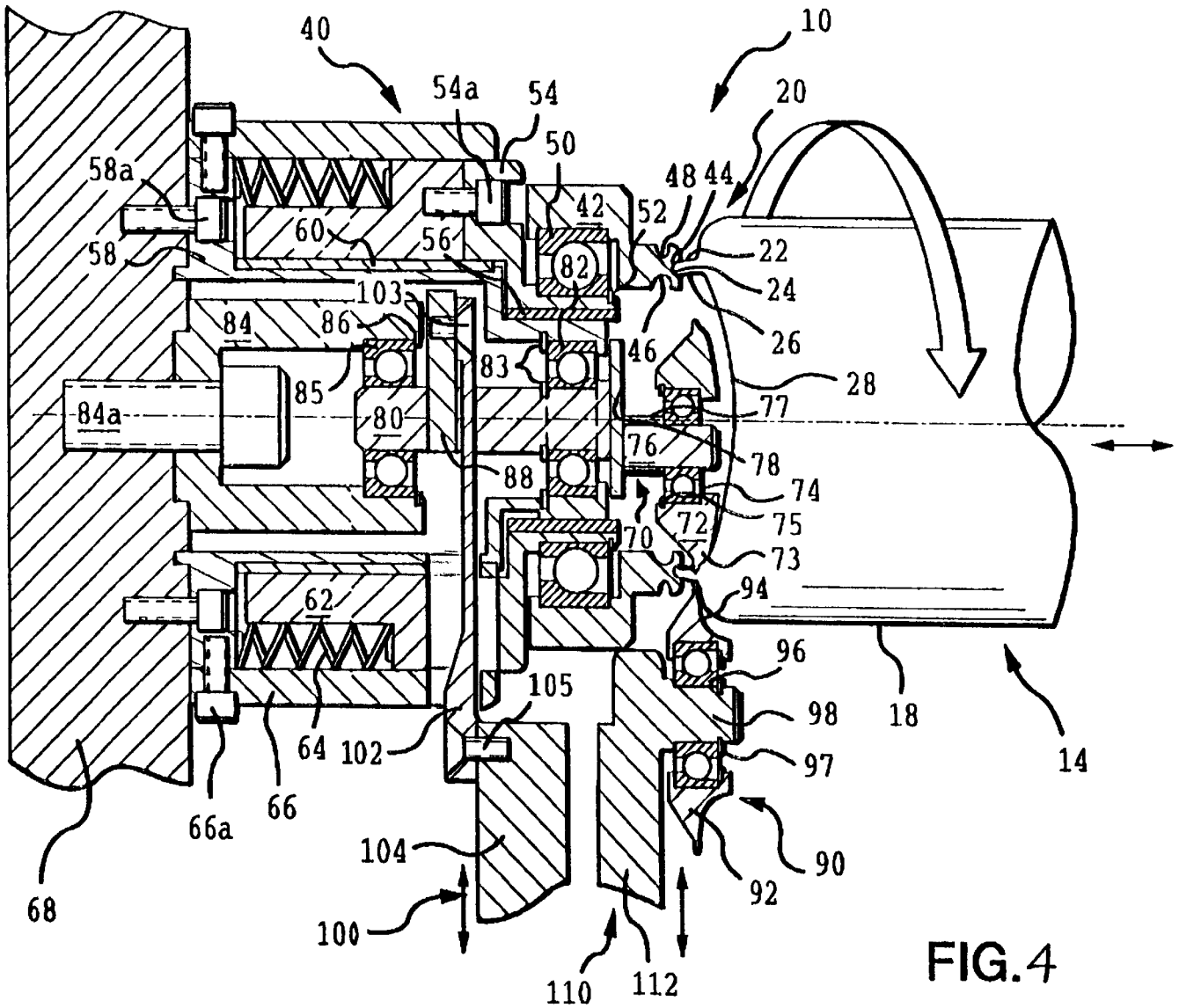
FIG. 4 is a sectional view of the container bottom reforming apparatus of FIG. 1 illustrating the inner and outer rollers in reforming positions.
Figure 5:
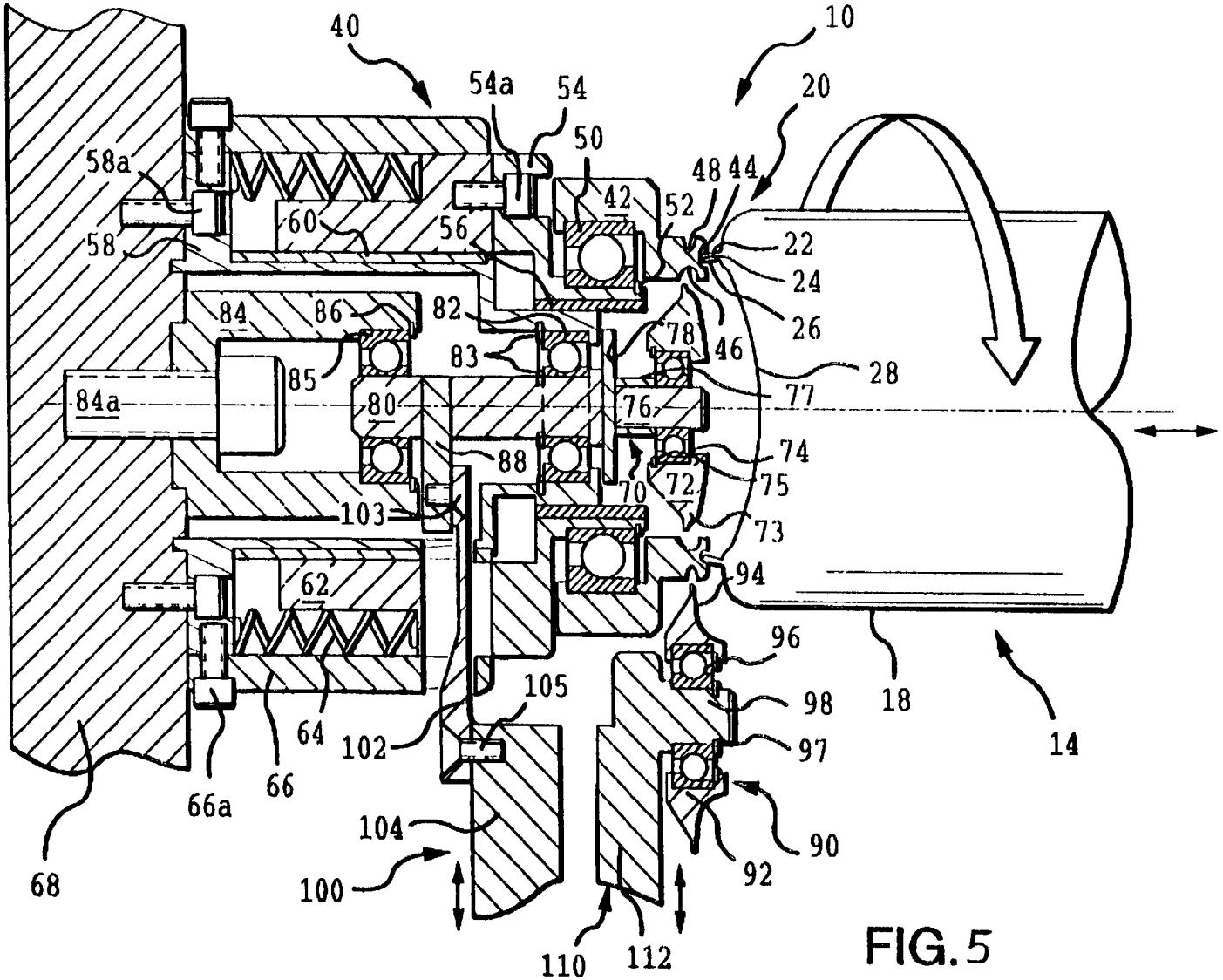
FIG. 5 is a sectional view of the container bottom reforming apparatus of FIG. 1 illustrating inner and outer rollers in post-reforming positions and a reformed container.
Figure 6A:
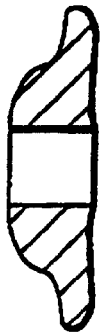
FIGS. 6A–6D illustrate alternative inner and outer roller reforming surfaces of the present invention.
Figure 6B:
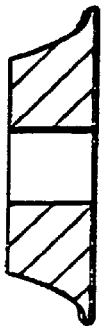
Figure 6C:
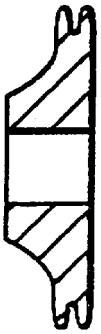
Figure 6D:
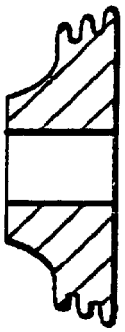

After initial engagement, further inward movement of follower 104, as shown in FIG. 4, causes inner roller 72 and reforming surface 73 to further engage inner surface 26 to complete reformation of surface 26. As can be appreciated, the final shape of inner surface 26 is dependent on the shape of reforming surface 73 which may be selected from various shapes as shown, for example, in FIGS. 6A–6D. Upon completing reformation, the follower 104 moves outward (due to the motion of cam follower 104) from container positioning assembly 40 thereby rotating central support member 80 and interconnected inner roller 72 back to their initial positions (e.g., disengaged positions), as shown in FIG. 5.

As can be appreciated, engagement and, if desired, reformation of outer surface 22 by rollers 92, may be completed concurrently with reformation of inner surface 26 and in a fashion similar to that described for inner surface 26. Referring to FIGS. 1 and 2, follower 112 of outer roller positioning assembly 110 is in contact with a cam (not shown), and as the apparatus 10 rotates relative to the cam, follower 112 is selectively moved radially inward and outward relative to outer surface 22 of bottom portion 20. As follower 112 moves toward outer surface 22, the interconnected outer roller assembly 90 likewise moves toward outer surface 22. In this manner, the reforming surfaces 94 of outer rollers 92 are advanced to initially engage outer surface 22 of spinning bottom portion 20 as shown in FIG. 3. Upon initial engagement, the outer rollers 92 begin to freely rotate about bearing member 96. Referring to FIG. 4, follower 112 and interconnected outer rollers 92 may be further advanced radially inward, if desired, to thereby reform the outer surface 22. As with the inner surface 26, the final reformation shape imparted to outer surface 22 may be controlled by the selection of various shapes (as shown in FIGS. 6A–6D) for reforming surface 94 of outer rollers 92. Upon completing reformation, the follower 112 is moved radially outward (i.e., due to the motion of cam follower 110) to disengage outer rollers 92 from outer surface 22 as shown in FIG. 5.

While the present invention has been described in relation to a specific embodiment, it will be appreciated that the invention may be utilized in numerous additional embodiments and procedures. Such additional embodiments and procedures are intended to be within the scope of the present invention.

What is claimed is:

1. An apparatus for reforming a bottom portion of a container having an outer wall that is disposed about a container axis, said bottom portion being attached to said outer wall and including an annular support surface, an outer surface for connecting said outer wall and said annular support surface, a recessed surface, and an inner surface for connecting said annular support surface and said recessed surface, said apparatus comprising:

rotating means for rotating said container about said container axis;

a container positioning assembly for selectively engaging and positioning said container, said container positioning assembly including a means for resiliently applying a compressive force to said container;

an inner roller positionable within a bottom portion of said container and outwardly advanceable for selectively engaging and reforming an inner surface of said bottom portion of said container wherein said container positioning assembly maintains said container in a predetermined axially centered location throughout said reforming of said inner surface by said inner roller.

2. An apparatus, as recited in claim 1, wherein said container positioning assembly means comprises a seat member having a seating surface for receiving said annular support surface of said bottom portion of said container, said seat member being free to rotate with said container.

3. An apparatus, as recited in claim 2, wherein said means for resiliently applying a comprehensible force includes at least one spring.

4. An apparatus, as recited in claim 1, further comprising:

an inner roller assembly for supporting and positioning said inner roller relative to said container, said inner roller assembly including a spindle for supporting said inner roller, said inner roller being free to rotate about a central axis of said spindle.

5. An apparatus, as recited in claim 4, wherein said inner roller assembly includes a central support member having a central axis substantially coinciding with said container axis, said spindle being coupled with said central support member with said central axis of said spindle being parallel to said central axis of said central support member for eccentrically positioning said inner roller relative to said central axis of said central support member.

6. An apparatus, as recited in claim 5, further comprising:

inner roller positioning means for rotating said central support member of said inner roller assembly about its central axis to move said eccentrically positioned inner roller transverse to said container axis for said selectively engaging and said reforming of said inner surface.

7. An apparatus as recited in claim 1, wherein said container positioning assembly is disposed to maintain said container in a substantially set axial location throughout said reforming of said inner surface by said inner roller.

8. An apparatus as recited in claim 1, wherein said container positioning assembly comprises a seat member for engaging said annular support surface of said bottom portion of a container, and at least one spring disposed to resiliently apply said compression force to said seat member during said reforming of an inner surface of a container by said inner roller.

9. An apparatus as recited in claim 8, wherein said seat member is provided to be freely rotatable with said container upon engagement therewith.

10. An apparatus as recited in claim 8, wherein said seat member is provided to engage said container at a first axial location upon initial contact, and retractable during such engagement to a second axial location during said reforming of said inner surface of said container by said inner roller, said second axial location being offset toward said spring relative to said first axial location.

11. An apparatus, as recited in claim 10, wherein said rotating means provides for axial advancement of said container toward said seat member, wherein said seat member is correspondingly retractable from said first axial location to said second axial location.

12. An apparatus as recited in claim 8, wherein said seat members is provided to engage a container at a first axial location on initial contact, and retractable during such engagement to a second axial location, and wherein said seat member comprises an inward facing recess for receiving a portion of said inner roller when said seat member remains in said first axial location and said inner roller is outwardly advanced.

13. An apparatus as recited in claim 12, further comprising:

at least one outer roller being inwardly advanceable to selectively engage an outer surface of a bottom portion of a container, and wherein said seat member comprises an outward facing recess for receiving a portion of said at least one outer roller when said seat member remains in said first axial location and said at least one outer roller is inwardly advanced.

14. An apparatus as recited in claim 13, further comprising:

at least a second outer roller for selectively engaging said outer surface of said bottom portion of said container in tandem with said first outer roller.

15. An apparatus are recited in claim 1, further comprising:

at least a first outer roller for selectively engaging said outer surface of said bottom portion of a container, wherein said inner and first outer rollers are operable for engaging said inner and outer surfaces, respectively, at least partially contemporaneously.

16. An apparatus for reforming a bottom portion of a container having an outer wall that is disposed about a container axis, said bottom portion being attached to said outer wall and including an annular support surface, an outer surface for connecting said outer wall and said annular support surface, a recessed surface, and an inner surface for connecting said annular support surface and said recessed surface, said apparatus comprising:

rotating means for rotating said container about said container axis;

an inner roller for selectively engaging said inner surface of said bottom portion of said container for reforming said inner surface;

an outer roller for selectively engaging said outer surface of said bottom portion of said container; and wherein, said inner and outer rollers are at least partially contemporaneously operable for said engaging of said inner and outer surfaces, respectively.

17. An apparatus, as recited in claim 16, further comprising:

an inner roller assembly for supporting and positioning said inner roller relative to said container, said inner roller assembly including a spindle for supporting said inner roller, said inner roller being free to independently rotate about a central axis of said spindle.

18. An apparatus, as recited in claimed 17, wherein said inner roller assembly includes a central support member having a central axis substantially coinciding with said container axis, said spindle of said inner roller assembly being coupled with said central support member with said central axis of said spindle being parallel to said central axis of said central support member for eccentrically positioning said inner roller relative to said central axis of said central support member.

19. An apparatus, as recited in claim 18, further comprising:

inner roller positioning means for rotating said central support member of said inner roller assembly about its central axis to move said eccentrically positioned inner roller transverse to said container axis for said selectively engaging and reforming of said inner surface.

20. An apparatus, as recited in claim 16, further comprising:

an outer roller assembly for supporting and positioning said at least one outer roller relative to said container, said outer roller assembly including a spindle for supporting said at least one outer roller, said at least one outer roller being free to independently rotate about a central axis of said spindle.

21. An apparatus, as recited in claim 20, further comprising:

outer roller positioning means for moving said outer roller assembly transverse to said container axis to urge said at least one outer roller to engage said outer surface for said reforming of said outer surface.

22. An apparatus, as recited in claim 16, further comprising:

an engaging member for selectively engaging and positioning said bottom portion of said container, said engaging member being spring loaded for resiliently applying a compressive force to said annular support surface of said bottom portion to maintain said container in a predetermined axially centered location.

23. A method for reforming a bottom portion of a container having a thin outer wall disposed about a container axis, said bottom portion being attached to said outer wall and including an annular support surface, an outer surface connecting said outer wall to said annular support surface, a recessed surface, and an inner surface connecting said annular support surface to said recessed surface, said method comprising the steps of:

positioning said container on a container rotating device with said bottom portion of said container being distal to said container rotating device;

resiliently applying a compressive force to at least said annular support surface of said bottom portion of said container to maintain said container in a predetermined axially centered location;

rotating said container about said container axis by operating said container rotating device;

outwardly advancing an inner roller to engage said inner surface of said bottom portion of said container;

inwardly advancing at least one outer roller to engage said outer surface of said bottom portion of said container, wherein said bottom portion of said container is engaged between said inner roller and said at least one outer roller, and wherein said outward advancement of said inner roller reform said inner surface of said bottom portion.

24. A method, as recited in claim 23, wherein said inwardly advancing and outwardly advancing steps are performed at least partially contemporaneously.

25. A method, as recited in claim 23, wherein:

said inward advancement of said at least one outer roller reforms said outer surface of said bottom portion, and wherein said outwardly advancing and inwardly advancing steps are performed at least partially contemporaneously.

26. A method, as recited in claim 23, wherein said inner and outer rollers rotate freely about their respective axes.

27. An apparatus for reforming a bottom portion of a container having an outer wall that is disposed about a container axis, said bottom portion being attached to said outer wall and including an annular support surface, an outer surface for connecting said outer wall and said annular support surface, a recessed surface, and an inner surface for connecting said annular support surface and said recessed surface, said apparatus comprising:

rotating means for rotating said container about said container axis;

an inner roller for selectively engaging said inner surface of said bottom portion at a first contact point for reforming said inner surface;

two outer rollers for selectively engaging said outer surface of said bottom portion at second and third contact points, each of said second and third contact points being annularly offset on said bottom portion relative to said first contact point; and wherein, said inner roller is operable for said reforming said inner surface.

28. An apparatus, as recited in claim 27, further comprising:

an inner roller assembly for supporting and positioning said inner roller relative to said container, said inner roller assembly including a spindle for supporting said inner roller, said inner roller being free to independently rotate about a central axis of said spindle.

29. An apparatus, as recited in claim 28, further comprising:

inner roller positioning means for moving said inner roller linearly transverse to said container axis to urge said inner roller to selectively engage said inner surface for said reforming of said inner surface.

30. An apparatus, as recited in claim 27, further comprising:

an outer roller assembly for supporting and positioning said two outer rollers relative to said container, said outer roller assembly including two spindles for supporting said two outer rollers, said two outer rollers being free to independently rotate about the central axes of said two spindles.

31. An apparatus, as recited in claim 30, further comprising:

outer roller positioning means for moving said outer roller assembly transverse to said container axis to urge said two outer rollers to engage said outer surface and for reforming of said outer surface.

32. An apparatus, as recited in claim 27, further comprising:

an engaging member for selectively engaging and positioning said bottom portion of said container, said engaging member including a spring means for resiliently applying a compressive force to said annular support surface of said bottom portion to maintain said container in a predetermined axially centered location.

* * * * *